US011117388B2

(12) United States Patent
Ito

(10) Patent No.: US 11,117,388 B2
(45) Date of Patent: Sep. 14, 2021

(54) THERMAL TRANSFER PRINTING DEVICE AND THERMAL TRANSFER SHEET

(71) Applicant: Dai Nippon Printing Co., Ltd., Tokyo (JP)

(72) Inventor: Takashi Ito, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 16/760,069

(22) PCT Filed: Dec. 3, 2018

(86) PCT No.: PCT/JP2018/044395
§ 371 (c)(1),
(2) Date: Apr. 29, 2020

(87) PCT Pub. No.: WO2019/111851
PCT Pub. Date: Jun. 13, 2019

(65) Prior Publication Data

US 2020/0353758 A1 Nov. 12, 2020

(30) Foreign Application Priority Data

Dec. 5, 2017 (JP) ..... JP2017-233478
Jan. 18, 2018 (JP) ..... JP2018-006638

(51) Int. Cl.
*B41J 2/325* (2006.01)
*B41J 35/16* (2006.01)
(Continued)

(52) U.S. Cl.
CPC ..... *B41J 2/325* (2013.01); *B41J 35/16* (2013.01); *B41J 35/18* (2013.01); *B41M 5/345* (2013.01)

(58) Field of Classification Search
CPC . B41J 2/325; B41J 35/16; B41J 35/18; B41M 5/345
See application file for complete search history.

(56) References Cited

U.S. PATENT DOCUMENTS 5,006,502 A * 4/1991 Fujimura ..... B41M 5/345 428/913
5,448,282 A * 9/1995 Imai ..... B41J 2/325 346/135.1
(Continued)

FOREIGN PATENT DOCUMENTS

CN 1351543 A 5/2020
JP S63-91281 A 4/1988
(Continued)

OTHER PUBLICATIONS

International Search Report and Written Opinion (Application No. PCT/JP2018/044395) dated Jan. 15, 2019.
(Continued)

*Primary Examiner* — Anh T Vo
(74) *Attorney, Agent, or Firm* — Burr & Brown, PLLC

(57) ABSTRACT

A thermal transfer sheet is provided, which can be produced with enhanced working efficiency and is identifiable, and a thermal transfer printing device which uses the thermal transfer sheet is also provided. The thermal transfer sheet includes a substrate, and a yellow dye layer, a magenta dye layer and a cyan dye layer disposed on the substrate. An interval between the yellow dye layer and the magenta dye layer is different from an interval between the magenta dye layer and the cyan dye layer. Alternatively, the yellow dye layer and the magenta dye layer overlap partially, and the magenta dye layer and the cyan dye layer overlap partially. The transfer printing device identifies the type of the thermal
(Continued)

transfer sheet based on the interval between the dye layers or the widths of the overlaps.

12 Claims, 6 Drawing Sheets

(51) Int. Cl.
*B41M 5/34* (2006.01)
*B41J 35/18* (2006.01)

(56) References Cited

U.S. PATENT DOCUMENTS 5,634,731 A * 6/1997 Kita ..... B41J 2/325 347/213
6,232,267 B1 * 5/2001 Oshima ..... B41M 5/025 428/32.76
6,333,295 B1 12/2001 Saito
6,386,772 B1 5/2002 Klinefelter et al.
6,778,200 B2 * 8/2004 Hann ..... B41J 31/05 347/178
10,434,791 B2 * 10/2019 Stangler ..... B41J 2/325
2001/0003020 A1 6/2001 Saito
2002/0025415 A1 2/2002 Saito
2003/0003278 A1 * 1/2003 Narita ..... B41M 3/144 428/195.1
2003/0017946 A1 1/2003 Saito
2003/0173406 A1 * 9/2003 Bi ..... B42D 25/00 235/491
2009/0278911 A1 11/2009 Howell et al.

FOREIGN PATENT DOCUMENTS

JP H06-099630 A1 4/1994
JP 2000-033781 A1 2/2000
JP 3629163 B2 3/2005
JP 2007-069508 A1 3/2007
JP 5334262 B2 11/2013

OTHER PUBLICATIONS

Chinese Office Action, Chinese Application No. 201880058846.7, dated Mar. 23, 2021 (11 pages).
Japanese Office Action, Japanese Application No. 2017-233478, dated Apr. 20, 2021 (3 pages).

* cited by examiner

THERMAL TRANSFER PRINTING DEVICE AND THERMAL TRANSFER SHEET

FIELD OF THE INVENTION

The present invention relates to thermal transfer printing devices and thermal transfer sheets.

BACKGROUND OF THE INVENTION

Thermal transfer printing devices produce a variety of full color images by thermally transferring sublimation dyes from a thermal transfer sheet onto a surface dyeable with sublimation dyes, for example, a receiver sheet such as paper or a plastic film having a dye receiving layer. The thermal transfer sheet has layers of sublimation transfer dyes as recording materials which are supported on a substrate such as a polyester film with an appropriate binder.

The recent progress in thermal transfer recording technology has led to a wider variety of thermal transfer sheets. Consequently, it is increasingly the case that various types of thermal transfer sheets are used in a single thermal transfer printer. To attain desired printing performance and desired durability, a printer needs to identify the type of a thermal transfer sheet and to control the amount of thermal energy applied to the thermal transfer sheet in accordance with the type of the sheet.

In conventional thermal transfer sheets, dye layers of three colors, i.e., a yellow dye layer, a magenta dye layer and a cyan dye layer, and a protective layer are repeated in planar sequence, and a detection mark is printed with an ink using a pigment such as carbon black or aluminum ahead of each of the dye layers of the three colors and the protective layer, or ahead of the dye layer of the color used first in a printing operation, for example, the yellow dye layer. A yellow image, a magenta image and a cyan image are transferred in a superimposed manner onto a receiver sheet to form a color image, and a protective layer is transferred onto the color image. During this process, the detection mark of the yellow dye layer in the thermal transfer sheet is read first, the yellow dye layer is then aligned with the printing start position of the receiver sheet, and the dye is printed. Next, the magenta dye layer is aligned with the printing start position of the receiver sheet, and the dye is printed. At this time, the detection mark which indicates the position of the magenta dye layer is not necessarily required when the thermal transfer sheet is delivered to the predetermined length. Other dyes such as cyan are aligned with the printing start position and printed in the similar manner.

Patent Literature 1 describes that a thermal transfer sheet is provided with a detection mark which includes portions partially differing in transmittance or reflectance when irradiated with an optical sensor, and information such as the type of the thermal transfer sheet is recognized based on the detection mark. However, the fact that different marks have to be formed depending on the types of thermal transfer films entails the fabrication of plates corresponding to the marks. Further, plate replacement is necessary when thermal transfer sheets with different marks are produced.

Patent Literature 2 describes a thermal transfer sheet in which a yellow dye layer is in the form of a binary pattern having different densities which indicate information of the sheet, and the information is recognized from the binary pattern. Such a thermal transfer sheet is produced by transferring an ink to a substrate using a gravure printing cylinder etched correspondingly to the binary pattern. When yellow dye layers with different information binary patterns are to be produced, it is necessary to fabricate as many cylinders as the binary patterns and to exchange cylinders during the production. Further, the binary pattern may not be read accurately if the ink transferred to the substrate is nonuniform in thickness.

PTL 1: Japanese Patent No. 3629163

PTL 2: Japanese Patent No. 5334262

SUMMARY OF THE INVENTION

The present invention has been made in light of the conventional circumstances discussed above. It is therefore an object of the present invention to provide a thermal transfer sheet which can be produced with enhanced working efficiency and is identifiable, and a thermal transfer printing device which uses the thermal transfer sheet. Further, an object of the present invention is to provide a thermal transfer sheet whose type can be identified with high accuracy on a thermal transfer printing device. Another object of the present invention is to provide a thermal transfer printing device which performs a printing operation while identifying the type of a thermal transfer sheet loaded therein.

According to the present invention, a thermal transfer printing device includes a thermal head and a platen roll and configured to superimpose a thermal transfer sheet supplied from a supply unit with printing paper and to deliver the thermal transfer sheet and the printing paper between the thermal head and the platen roll in such a manner that the thermal head heats the thermal transfer sheet and transfers colorants to the printing paper to form an image thereon. The thermal transfer printing device includes a first memory storing a first table containing a plurality of types of thermal transfer sheets in connection with information regarding the intervals between colorant layers disposed in planar sequence in each of the thermal transfer sheets, a first identification unit measuring the intervals between colorant layers disposed in planar sequence in the thermal transfer sheet supplied from the supply unit and identifying the type of the thermal transfer sheet supplied from the supply unit based on results of interval measurement with reference to the first table, a sensor disposed between the supply unit and the thermal head, applying visible light to a yellow dye layer, a magenta dye layer and a cyan dye layer disposed in the thermal transfer sheet, and measuring at least either of intensities of light transmitted through each of the dye layers and intensities of light reflected by each of the dye layers, a second memory storing a second table containing types of thermal transfer sheets in connection with patterns of densities of a yellow dye layer, a magenta dye layer and a cyan dye layer in each type of the thermal transfer sheet or patterns of optical intensifies based on the densities, and a second identification unit identifying the type of the thermal transfer sheet supplied from the supply unit based on measurement results from the sensor with reference to the second table. The first identification unit identifies the type of the thermal transfer sheet based on results of measurement of the interval between the yellow dye layer and the magenta dye layer and the interval between the magenta dye layer and the cyan dye layer, printing conditions are associated with types of thermal transfer sheets in the first table or the second table, and the thermal transfer printing device performs a printing operation under printing conditions corresponding to the type of the thermal transfer sheet identified by the first identification unit or the second identification unit.

According to the present invention, a thermal transfer printing device includes a thermal head and a platen roll and configured to superimpose a thermal transfer sheet supplied from a supply unit with printing paper and to deliver the thermal transfer sheet and the printing paper between the thermal head and the platen roll in such a manner that the thermal head heats the thermal transfer sheet and transfers colorants to the printing paper to form an image thereon. The thermal transfer printing device includes a memory storing a table containing a plurality of types of thermal transfer sheets in connection with information regarding the intervals between colorant layers disposed in planar sequence in each of the thermal transfer sheets, and an identification unit measuring the intervals between colorant layers disposed in planar sequence in the thermal transfer sheet supplied from the supply unit and identifying the type of the thermal transfer sheet supplied from the supply unit based on results of interval measurement with reference to the table.

According to one aspect of the present invention, the colorant layers include a yellow dye layer, a magenta dye layer and a cyan dye layer disposed in planar sequence, and the identification unit identifies the type of the thermal transfer sheet based on results of measurement of the interval between the yellow dye layer and the magenta dye layer and the interval between the magenta dye layer and the cyan dye layer.

According to one aspect of the present invention, the colorant layers include a yellow dye layer, a magenta dye layer and a cyan dye layer, and the identification unit identifies the type of the thermal transfer sheet based on whether the yellow dye layer and the magenta dye layer are separated from each other and whether the magenta dye layer and the cyan dye layer are separated from each other.

According to one aspect of the present invention, the colorant layers include a yellow dye layer, a magenta dye layer and a cyan dye layer, and the identification unit identifies the type of the thermal transfer sheet based on at least either of the width of a mixed color region formed by overlapping of the yellow dye layer and the magenta dye layer, and the width of a mixed color region formed by overlapping of the magenta dye layer and the cyan dye layer.

According to one aspect of the present invention, printing conditions are associated with the types of the thermal transfer sheets in the table, and the thermal transfer printing device performs a printing operation under printing conditions corresponding to the type of the thermal transfer sheet identified by the identification unit.

According to the present invention, a thermal transfer sheet includes a substrate, and a yellow colorant layer, a magenta colorant layer and a cyan colorant layer disposed on the substrate. An interval between the yellow colorant layer and the magenta colorant layer is different from an interval between the magenta colorant layer and the cyan colorant layer.

According to the present invention, a thermal transfer sheet includes a substrate, and a yellow colorant layer, a magenta colorant layer and a cyan colorant layer disposed on the substrate. The thermal transfer sheet includes at least either of a mixed color region formed by overlapping of the yellow colorant layer and the magenta colorant layer, and a mixed color region formed by overlapping of the magenta colorant layer and the cyan colorant layer.

According to the present invention, a thermal transfer printing device includes a thermal head and a platen roll and configured to superimpose a thermal transfer sheet comprising a yellow dye layer, a magenta dye layer and a cyan dye layer with printing paper and to deliver the thermal transfer sheet and the printing paper between the thermal head and the platen roll in such a manner that the thermal head heats the thermal transfer sheet and transfers the dyes to the printing paper to form an image thereon. The thermal transfer printing device includes a sensor disposed between the thermal head and a supply unit configured to supply the thermal transfer sheet, applying visible light to at least two dye layers selected from the yellow dye layer, the magenta dye layer and the cyan dye layer, and measuring at least either of the intensities of light transmitted through each of the dye layers irradiated with the visible light and the intensities of light reflected by each of the dye layers irradiated with the visible light, a memory storing a table containing types of thermal transfer sheets in connection with patterns of densities of at least two dye layers selected from a yellow dye layer, a magenta dye layer and a cyan dye layer in each type of the thermal transfer sheet or patterns of optical intensifies based on the densities, and an identification unit identifying the type of the thermal transfer sheet supplied from the supply unit based on measurement results from the sensor with reference to the table.

According to the present invention, a thermal transfer printing device includes a thermal head and a platen roll and configured to superimpose a thermal transfer sheet comprising a yellow dye layer, a magenta dye layer and a cyan dye layer with printing paper and to deliver the thermal transfer sheet and the printing paper between the thermal head and the platen roll in such a manner that the thermal head heats the thermal transfer sheet and transfers the dyes to the printing paper to form an image thereon. The thermal transfer printing device includes a sensor disposed between the thermal head and a supply unit configured to supply the thermal transfer sheet, applying invisible light to at least two dye layers selected from the yellow dye layer, the magenta dye layer and the cyan dye layer, and measuring at least one of the intensities of light transmitted through, the intensities of light reflected by, and the intensities of light generated in each of the dye layers irradiated with the invisible light, a memory storing a table containing types of thermal transfer sheets in connection with patterns of contents of an invisible light absorbing material in at least two dye layers selected from a yellow dye layer, a magenta dye layer and a cyan dye layer in each type of the thermal transfer sheet or patterns of optical intensifies based on the contents, and an identification unit identifying the type of the thermal transfer sheet supplied from the supply unit based on measurement results from the sensor with reference to the table.

According to the present invention, a thermal transfer printing device includes a thermal head and a platen roll and configured to superimpose a thermal transfer sheet comprising a yellow dye layer, a magenta dye layer and a cyan dye layer with printing paper and to deliver the thermal transfer sheet and the printing paper between the thermal head and the platen roll in such a manner that the thermal head heats the thermal transfer sheet and transfers the dyes to the printing paper to form an image thereon. The thermal transfer printing device includes a sensor measuring densities of at least two detection marks selected from a first detection mark indicating a head position of the yellow dye layer, a second detection mark indicating a head position of the magenta dye layer, and a third detection mark indicating a head position of the cyan dye layer, a memory storing a table containing types of thermal transfer sheets in connection with patterns of densities of at least two detection marks selected from first to third detection marks in each type of the thermal transfer sheet, and an identification unit identifying the type of the thermal transfer sheet supplied from the supply unit based on measurement results from the sensor with reference to the table.

According to one aspect of the present invention, printing conditions are associated with the types of the thermal transfer sheets in the table, and the thermal transfer printing device performs a printing operation under printing conditions corresponding to the type of the thermal transfer sheet identified by the identification unit.

According to the present invention, a thermal transfer sheet includes a base film, and a yellow dye layer, a magenta dye layer and a cyan dye layer disposed on the base film. The yellow dye layer, the magenta dye layer and the cyan dye layer are a mixture of a dye layer containing an invisible light absorbing material and a dye layer containing no invisible light absorbing material.

According to the present invention, a thermal transfer sheet includes a base film, and a yellow dye layer, a magenta dye layer and a cyan dye layer disposed on the base film. The thermal transfer sheet includes a first detection mark indicating a head position of the yellow dye layer, a second detection mark indicating a head position of the magenta dye layer, and a third detection mark indicating a head position of the cyan dye layer, and the first detection mark differs in density from at least either of the second detection mark and the third detection mark.

Advantageous Effects of Invention

According to the present invention, the type of a thermal transfer sheet can be identified based on the interval or overlapped width between adjacent dye layers in the thermal transfer sheet. The present invention eliminates the need of fabricating plates or gravure printing cylinders for every types of thermal transfer sheets, and can enhance the working efficiency in manufacturing. Further, according to the present invention, the types of thermal transfer sheets are expressed by patterns of densities of a yellow dye layer, a magenta dye layer and a cyan dye layer, and thus the type of a thermal transfer sheet can be identified with high accuracy on a thermal transfer printing device.

DETAILED DESCRIPTION OF THE INVENTION

Figure 1:
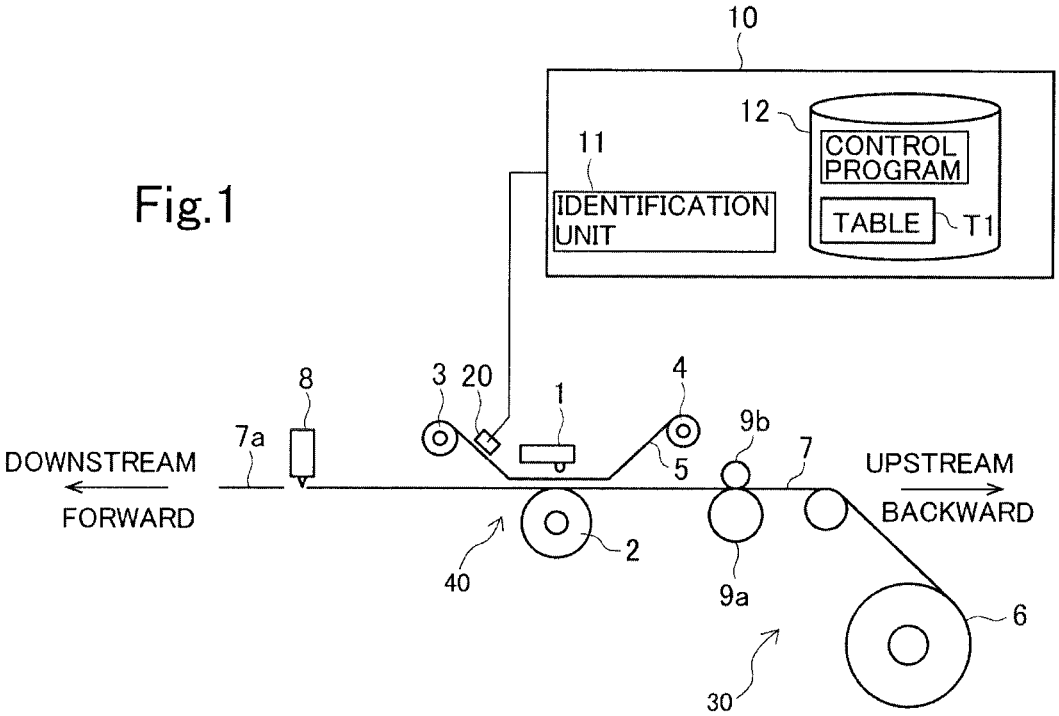
FIG. 1 is a schematic configuration diagram of a thermal transfer printing device according to an embodiment of the present invention.
Figure 2:
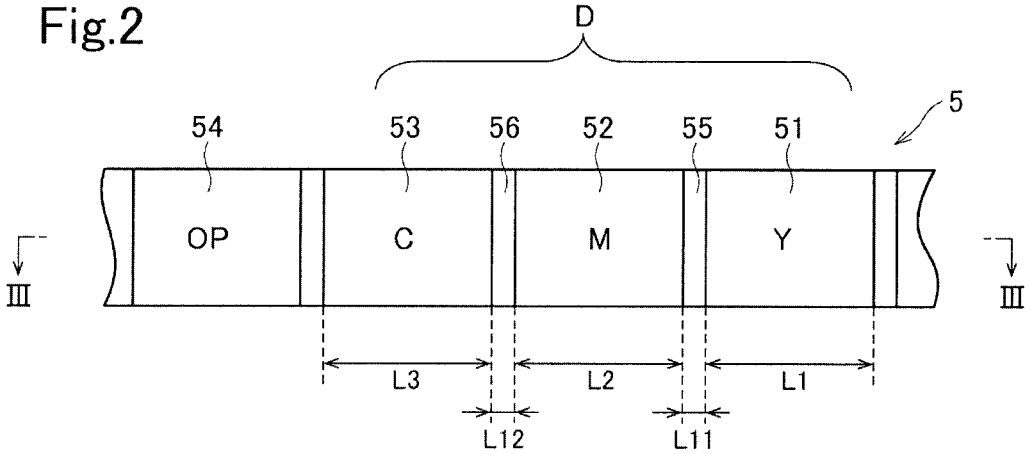
FIG. 2 is a plan view of a thermal transfer sheet according to the embodiment.
Figure 3:
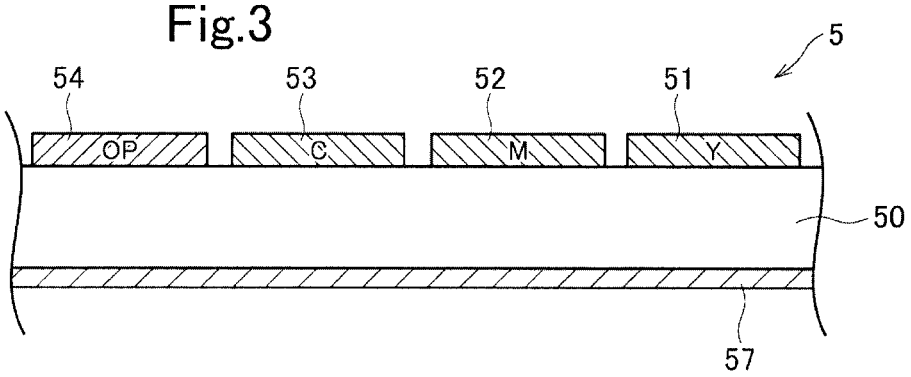
FIG. 3 is a sectional view along line III-III in FIG. 2.

FIG. 1 is a schematic configuration diagram of a thermal transfer printing device according to an embodiment of the present invention. FIG. 2 is a plan view of a thermal transfer sheet 5 used in the thermal transfer printing device. FIG. 3 is a sectional view of the thermal transfer sheet 5.

The thermal transfer sheet 5 has a configuration in which dye layers D containing a dye and a binder resin, and a transferable protective layer (hereinafter, written as the protective layer 54) are disposed in a repeated planar sequence on one side of a substrate 50, and a back layer 57 is disposed on the other side of the substrate 50. The dye layers D include a yellow dye layer, a magenta dye layer and a cyan dye layer (hereinafter, these layers are written as the Y layer 51, the M layer 52 and the C layer 53, respectively) arranged in a planar sequence. A dye primer layer may be disposed between the dye layers D and the protective layer 54, and the substrate 50. Further, a back primer layer may be disposed between the substrate 50 and the back layer 57.

The thermal transfer printing device includes a thermal head 1 which sublimates and transfers Y, M and C from the thermal transfer sheet 5 onto a printing sheet 7 (photographic printing paper, receiver paper) to print an image, and forms a protective layer on the image.

A supply unit 3 which includes a reel of the thermal transfer sheet 5 is disposed downstream of the thermal head 1, and a collection unit 4 is disposed upstream of the thermal head 1. The thermal transfer sheet 5 fed from the supply unit 3 is passed under the thermal head 1 and is collected in the collection unit 4.

A rotatable platen roll 2 is disposed below the thermal head 1. A printing section 40 including the thermal head 1 and the platen roll 2 sandwiches the printing sheet 7 and the thermal transfer sheet 5, and heats the thermal transfer sheet 5 to thermally transfer the dyes onto the printing sheet 7, thus forming an image.

Further, the printing section 40 heats the protective layer 54 to transfer the protective layer onto the image. The protective layer has a matte surface with low gloss when the protective layer is formed with high transferring energy (the printing energy applied by the printing section 40), and has a shiny surface with high gloss when the transferring energy is lowered.

Upstream of the thermal head 1 are disposed a rotatably drivable capstan roller 9*a* for transporting the printing sheet 7, and a pinch roller 9*b* which presses the printing sheet 7 against the capstan roller 9*a*.

The printing sheet 7 is wound on a printing paper reel 6 and is fed from the printing paper reel 6. The printing sheet 7 may be a known sheet. A driving section 30 which includes the printing paper reel 6, the capstan roller 9*a* and the pinch roller 9*b* feeds (transports forward) and takes up (transports backward) the printing sheet 7.

The printing sheet 7 on which the image is formed and the protective layer is transferred at the printing section 40 is cut with a cutter 8 on the downstream side to give a printed sheet 7*a*. The printed sheet 7*a* is discharged from an outlet that is not illustrated.

The thermal transfer printing device includes a detector 20 which applies light to the thermal transfer sheet 5 fed from the supply unit 3, and determines the color and position of the dye layer D based on the amount of transmitted light and/or the amount of reflected light in a predetermined range of wavelengths. The detector 20 is disposed between the supply unit 3 and the thermal head 1. Further, a rotary encoder (not shown) is attached to the feeding shaft of the supply unit 3, the take-up shaft of the collection unit 4, or the roller shaft of a transport roller (not shown) disposed on the route on which the thermal transfer sheet 5 is transported.

A control section 10 acquires detection results from the detector 20 and also output pulse signals from the rotary encoder, and measures the numbers of regional pulses in the Y layer 51, the M layer 52, the C layer 53, a region 55 between the Y layer 51 and the M layer 52, and a region 56 between the M layer 52 and the C layer 53.

For example, the control section 10 counts the number of pulses during the period in which the detector 20 is detecting the Y layer 51, and thus determines the regional pulse count of the Y layer 51. The control section 10 counts the number of pulses from the time when the detector 20 completes the detection of the Y layer 51 to the time when the detector 20 starts to detect the M layer 52, and thus determines the regional pulse count of the region 55.

Similarly, the control section 10 counts the number of pulses during the period in which the detector 20 is detecting the M layer 52, and thus determines the regional pulse count of the M layer 52. The control section 10 counts the number of pulses from the time when the detector 20 completes the detection of the M layer 52 to the time when the detector 20 starts to detect the C layer 53, and thus determines the regional pulse count of the region 56. The control section 10 counts the number of pulses during the period in which the detector 20 is detecting the C layer 53, and thus determines the regional pulse count of the C layer 53.

The regional pulse counts of the Y layer 51, the M layer 52 and the C layer 53 correspond to the lengths L1, L2 and L3 of the Y layer 51, the M layer 52 and the C layer 53, respectively, in the direction in which the thermal transfer sheet is fed (the longitudinal direction of the thermal transfer sheet 5). Further, the regional pulse counts of the region 55 and the region 56 correspond to the lengths L11 and L12 of the regions 55 and 56, respectively, in the direction in which the thermal transfer sheet is fed.

Figure 4A:
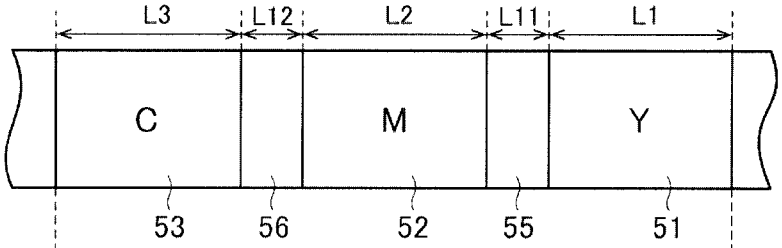
FIGS. 4*a* to 4*c* are plan views of thermal transfer sheets.
Figure 4B:
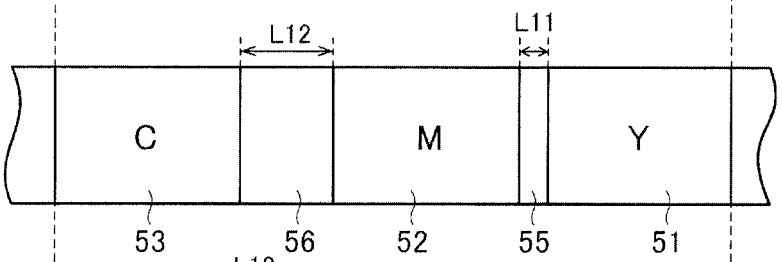
Figure 4C:
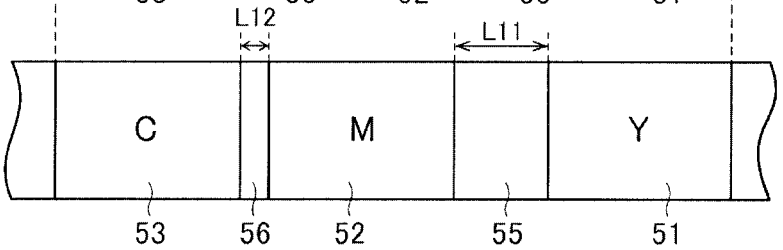

The thermal transfer printing device may be loaded with a plurality of types of thermal transfer sheets 5. As illustrated in FIGS. 4*a* to 4*c*, the thermal transfer sheets 5 have different lengths L11 and L12 depending on their types. In other words, the differences in the lengths L11 and L12 express the types of the thermal transfer sheets 5. The thermal transfer sheets 5 have a constant length from the front end of the Y layer 51 to the rear end of the C layer 53 regardless of the types of the sheets.

A memory unit 12 which will be described later stores a table T1 containing types of thermal transfer sheets 5 in connection with information such as the ratio of the regional pulse count of a Y layer 51 to the regional pulse count of a region 55, and the ratio of the regional pulse count of an M layer 52 to the regional pulse count of a region 56.

The controller 10 controls the driving of each unit or section of the thermal transfer printing device, and performs an operation to identify the thermal transfer sheet 5 and also a printing operation. The controller 10 is a computer which has a memory unit 12 including CPU (a central processing unit), a flash memory, ROM (a read-only memory) and RAM (a random access memory). The memory unit 12 stores control programs, and the table T1 described above. CPU executing the control programs functions as an identification unit 11.

Based on the outputs from the detector 20 and the rotary encoder, the identification unit 11 calculates the ratio of the regional pulse count of the Y layer 51 to the regional pulse count of the region 55, and the ratio of the regional pulse count of the M layer 52 to the regional pulse count of the region 56. With reference to the table T1, the identification unit 11 then identifies the type of the thermal transfer sheet 5 based on the ratios calculated. The table T1 may contain information such as preferred printing conditions (printing speed, energy applied during printing) and the types of printing sheets 7 to be used, in connection with the types of the thermal transfer sheets 5. If the type of the printing sheet 7 loaded in the thermal transfer printing device does not match the type of the thermal transfer sheet 5 that has been identified, the controller 10 may output a warning sound or a warning display, or may stop the printing operation.

In the case where the rotary encoder is attached to the feeding shaft of the supply unit 3 or the take-up shaft of the collection unit 4, the regional pulse counts change due to the change in sheet coil diameter even when the lengths L1 to L3, L11 and L12 are constant. It is therefore preferable that the type of the thermal transfer sheet 5 be identified based on the ratios of the regional pulse counts.

In the case where the rotary encoder is attached to a transport roller disposed on the route on which the thermal transfer sheet 5 is transported, the regional pulse counts do not change in spite of the change in sheet coil diameter as long as the lengths L1 to L3, L11 and L12 are constant. Thus, the table T1 may simply contain types of thermal transfer sheets 5 in connection with the regional pulse counts of a region 55 and a region 56. The identification unit 11 counts the number of regional pulses in the region 55 and the number of regional pulses in the region 56 based on the outputs from the detector 20 and the rotary encoder, and can identify the type of the thermal transfer sheet 5 based on the determined regional pulse counts with reference to the table T1.

Next, a configuration of the thermal transfer sheet 5 will be described.

[Substrates]

The substrate 50 used in the thermal transfer sheet 5 may be any known substrate as long as it has certain levels of heat resistance and strength. Examples thereof include resin films such as polyethylene terephthalate films, 1,4-polycyclohexylene dimethylene terephthalate films, polyethylene naphthalate films, polyphenylene sulfide films, polystyrene films, polypropylene films, polysulfone films, aramid films, polycarbonate films, polyvinyl alcohol films, cellulose derivatives including cellophane and cellulose acetate, polyethylene films, polyvinyl chloride films, nylon films, polyimide films and ionomer films.

The substrate 50 generally has a thickness of about not less than 0.5 μm and not more than 50 μm, and preferably about not less than 3.0 μm and not more than 10 μm. The substrate 50 may be surface-treated to attain enhanced adhesion with respect to a layer in contact with the substrate 50. The surface treatment that is adopted here may be a known resin surface modification technique such as corona discharge treatment, flame treatment, ozone treatment, ultraviolet treatment, radiation treatment, roughening treatment, chemical treatment, plasma treatment or grafting treatment. One, or two or more kinds of surface treatments may be performed.

Of the above surface treatments, corona treatment or plasma treatment is preferable because of low cost. Further, where necessary, an underlayer (a primer layer) may be formed on one or both sides of the substrate 50. The primer treatment may be performed by, for example, melt extruding a plastic film in such a manner that the unstretched film is coated with a primer solution and is thereafter stretched. Alternatively, a primer layer (a bonding layer) may be applied between the substrate 50 and the back layer 57. For example, the primer layer may be formed using, among others, a polyester resin, a polyacrylate ester resin, a polyvinyl acetate resin, a polyurethane resin, a styrene acrylate resin, a polyacrylamide resin, a polyamide resin, a polyether resin, a polystyrene resin, a polyethylene resin, a polypropylene resin, a vinyl resin such as a polyvinyl chloride resin, a polyvinyl alcohol resin or a polyvinylidene chloride resin, a polyvinyl acetal resin such as polyvinyl acetoacetal or polyvinyl butyral, or a cellulose resin.

[Dye Layers]

The dye layers D preferably include a material in which a sublimation dye is melted or dispersed in a binder resin. Examples of the sublimation dyes include diarylmethane dyes; triarylmethane dyes; thiazole dyes; merocyanine dyes; pyrazolone dyes; methine dyes; indoaniline dyes; azomethine dyes such as acetophenone azomethine, pyrazoloazomethine, imidazole azomethine, imidazoazomethine and pyridone azomethine; xanthene dyes; oxazine dyes; cyanostyrene dyes such as dicyanostyrene and tricyanostyrene; thiazine dyes; azine dyes; acridine dyes; benzene azo dyes; azo dyes such as pyridone azo, thiophene azo, isothiazole azo, pyrrole azo, pyrazole azo, imidazole azo, thiadiazole azo, triazole azo and disazo; spiropyran dyes; indolinospiropyran dyes; fluoran dyes; rhodamine lactam dyes; naphthoquinone dyes; anthraquinone dyes; and quinophthalone dyes.

In the dye layer, the amount of the sublimation dye is not less than 5 mass % and not more than 90 mass %, and preferably not less than 20 mass % and not more than 80 mass % relative to the total solid content of the dye layer. If the sublimation dye is used in an amount below the above range, the print density may be low. If the amount exceeds the above range, properties such as storage properties may be deteriorated.

The binder resin used to hold the dye may be generally one which has heat resistance and appropriate affinity for dyes. Examples of the binder resins include cellulose resins such as ethyl cellulose, hydroxyethyl cellulose, ethyl hydroxycellulose, hydroxypropyl cellulose, methyl cellulose, cellulose acetate and cellulose butyrate; vinyl resins such as polyvinyl alcohol, polyvinyl acetate, polyvinyl butyral, polyvinyl acetoacetal and polyvinylpyrrolidone; acrylic resins such as poly(meth)acrylate and poly(meth) acrylamide; polyurethane resins; polyamide resins; and polyester resins. Of the binder resins described above, among others, cellulose resins, vinyl resins, acrylic resins, urethane resins and polyester resins are preferable because of their excellent properties such as heat resistance and dye migration. Vinyl resins are more preferable, and, among others, polyvinyl butyral and polyvinyl acetoacetal are particularly preferable.

The dye layers D may contain additives such as a release agent, inorganic microparticles and organic microparticles. Examples of the release agents include silicone oils and phosphate esters. Examples of the inorganic microparticles include carbon black, aluminum and molybdenum disulfide. Examples of the organic microparticles include polyethylene wax.

The dye layers D may be formed by dissolving or dispersing the dye and the binder resin, optionally together with additives, into an appropriate organic solvent or water to prepare a coating liquid, and applying the coating liquid onto a side of the substrate 50 by a known method such as a gravure printing method, a screen printing method or a reverse roll coating printing method using a gravure plate, followed by drying.

Examples of the organic solvents include toluene, methyl ethyl ketone, ethanol, isopropyl alcohol, cyclohexanone and dimethylformamide [DMF]. The thickness of the dye layers D as measured after drying is about not less than 0.2 μm and not more than 6.0 μm, and preferably about not less than 0.2 μm and not more than 3.0 μm.

[Protective Layers]

The protective layer 54 may include any of various resins conventionally known as protective layer-forming resins. Examples of the protective layer-forming resins include polyester resins, polystyrene resins, acrylic resins, polyurethane resins, acrylic urethane resins, vinyl chloride-vinyl acetate copolymers, resins obtained by modifying the above resins with silicones, and mixtures of the above resins.

The protective layer 54 may be formed by, for example, applying a coating liquid containing the resin using a gravure printing method, and drying the wet film. The thickness of the protective layer 54 in the form of a dry film is preferably not less than 0.1 μm and not more than 2.0 μm.

[Back Layers]

In the thermal transfer sheet 5, the back layer 57 is disposed on the side of the substrate 50 opposite to the side having the dye layers D and the protective layer 54. The back layer 57 is provided in order to enhance properties such as heat resistance and the running performance on the thermal head 1 during printing.

The back layer 57 may be formed with a material appropriately selected from known thermoplastic resins and the like. Examples of the thermoplastic resins include polyester resins, polyacrylate ester resins, polyvinyl acetate resins, styrene acrylate resins, polyurethane resins, polyolefin resins such as polyethylene resins and polypropylene resins, polystyrene resins, polyvinyl chloride resins, polyether resins, polyamide resins, polyimide resins, polyamideimide resins, polycarbonate resins, polyacrylamide resins, polyvinyl chloride resins, polyvinyl acetal resins such as polyvinyl butyral resins and polyvinyl acetoacetal resins, and silicone-modified products of these resins.

Further, a curing agent may be added to the resin described above. Polyisocyanate resins function as curing agents, and known such resins may be used without limitation. Of such resins, an adduct of an aromatic isocyanate may be desirably used. Examples of the aromatic polyisocyanates include 2,4-toluene diisocyanate, 2,6-toluene diisocyanate, mixture of 2,4-toluene diisocyanate and 2,6-toluene diisocyanate, 1,5-naphthalene diisocyanate, tolidine diisocyanate, p-phenylene diisocyanate, trans-cyclohexane-1,4-diisocyanate, xylylene diisocyanate, triphenylmethane triisocyanate and tris(isocyanatophenyl) thiophosphate. In particular, 2,4-toluene diisocyanate, 2,6-toluene diisocyanate, or mixture of 2,4-toluene diisocyanate and 2,6-toluene diisocyanate is preferable. These polyisocyanate resins crosslink molecules of the hydroxyl-containing thermoplastic resin mentioned above by utilizing the hydroxyl groups, and thus enhance the film strength and heat resistance of the back layer 57.

Further, the back layer 57 may contain, in addition to the thermoplastic resin, various additives including release agents such as waxes, higher fatty acid amides, phosphate ester compounds, metal soaps, silicone oils and surfactants, organic powders such as fluororesins, and inorganic particles such as silica, clay, talc and calcium carbonate, for the purpose of enhancing slipping properties.

The back layer 57 may be formed by, for example, dispersing or dissolving the thermoplastic resin and optional additives into an appropriate solvent to prepare a coating liquid, and applying the coating liquid onto the side of the substrate 50 opposite to the dye layers D and the protective layer 54 using a known method such as a gravure printing method, a screen printing method or a reverse roll coating printing method using a gravure plate, followed by drying.

From points of view such as enhancements in heat resistance and other properties, the thickness of the back layer 57 is preferably not more than 3 μm as measured after drying, and more preferably not less than 0.1 μm and not more than 2 μm.

In a printing operation using the thermal transfer sheet 5, first, the printing sheet 7 is aligned with the Y layer 51 of the dye layers D, and the thermal head 1 is placed in contact with the platen roll 2 via the printing sheet 7 and the thermal transfer sheet 5. Next, the capstan roller 9*a* and the collection unit 4 are driven to rotate, and the printing sheet 7 and the thermal transfer sheet 5 are delivered to the backward side. During this process, the thermal head 1 sequentially heats regions defined by the Y layers 51 in a selective manner based on the image data, and Y is sublimated and transferred from the thermal transfer sheet 5 onto the printing sheet 7.

After Y has been sublimated and transferred, the thermal head 1 is lifted away from the platen roll 2. Next, the printing sheet 7 is aligned with the M layer 52. In the same manner as the sublimation and transferring of Y, M and C are sequentially sublimated and transferred onto the printing sheet 7 based on the image data, thus forming an image on the printing sheet 7.

After the image has been formed, the printing sheet 7 is aligned with the protective layer 54, and the protective layer 54 is heated by the thermal head 1 so as to transfer the protective layer over the image from the thermal transfer sheet 5 onto the printing sheet 7.

In the present embodiment, the information for identifying the type of the thermal transfer sheet 5 is expressed by the length L11 of the region 55 between the Y layer 51 and the M layer 52 (the interval between the Y layer 51 and the M layer 52) and the length L12 of the region 56 between the M layer 52 and the C layer 53 (the interval between the M layer 52 and the C layer 53). There is no need to fabricate plates or gravure printing cylinders corresponding to the types of the thermal transfer sheets 5, and thus the working efficiency during manufacturing can be enhanced.

Figure 5A:
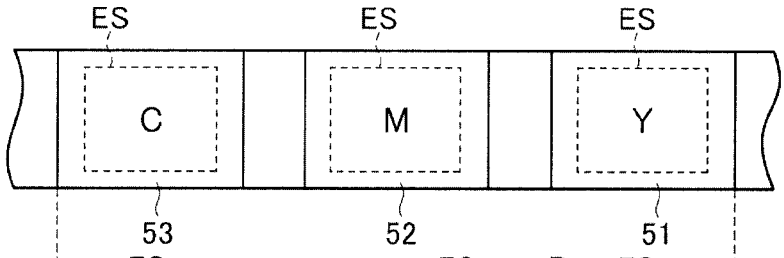
FIGS. 5*a* to 5*c* are plan views of thermal transfer sheets.
Figure 5B:
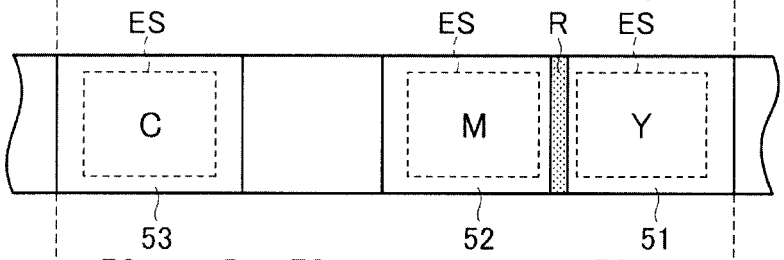
Figure 5C:
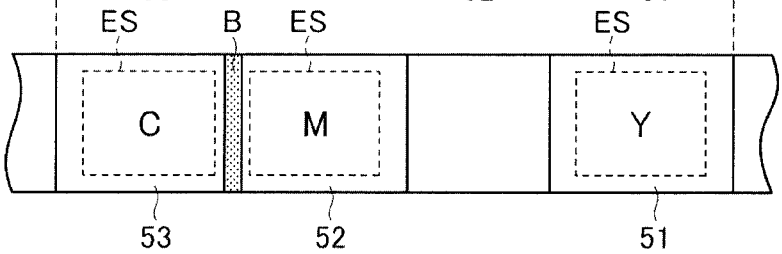

As illustrated in FIG. 5*b*, a rear end portion of the Y layer 51 and a front end portion of the M layer 52 may be overlapped with each other. Further, as illustrated in FIG. 5*c*, a rear end portion of the M layer 52 and a front end portion of the C layer 53 may be overlapped with each other. The sizes of the Y layer 51, the M layer 52 and the C layer 53 are larger than the effective screens ES used for image formation on the printing sheet 7. Printout quality is not adversely affected as long as the mixed color region (the red layer R) formed by overlapping of the Y layer 51 and the M layer 52 or the mixed color region (the blue layer B) formed by overlapping of the M layer 52 and the C layer 53 does not reach the effective screen ES.

In the examples shown in FIGS. 5*a* to 5*c*, the identification unit 11 determines whether the Y layer 51 and the M layer 52 are separated from each other and whether the M layer 52 and the C layer 53 are separated from each other, and can thus identify the type of the thermal transfer sheet 5.

Figure 6A:
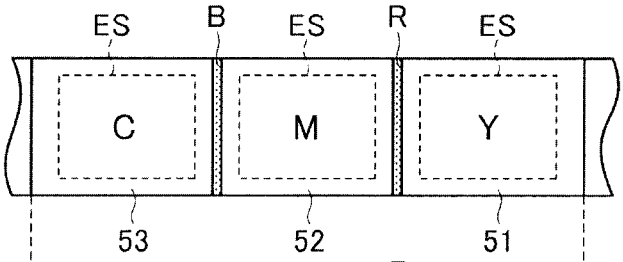
FIGS. 6*a* to 6*c* are plan views of thermal transfer sheets.
Figure 6B:
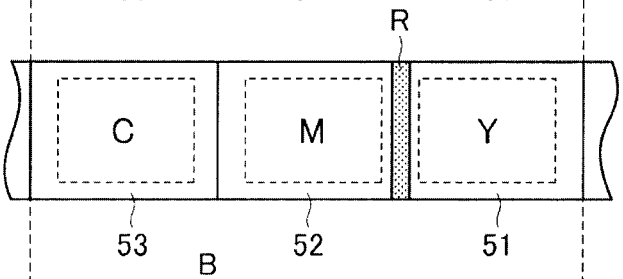
Figure 6C:
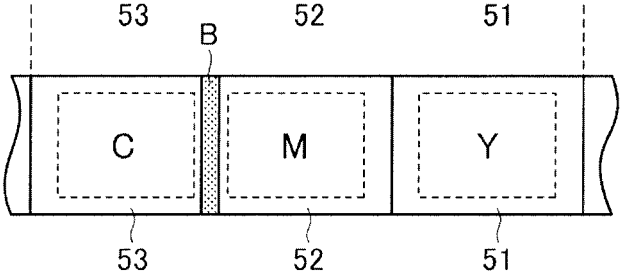

As illustrated in FIGS. 6*a* to 6*c*, the Y layer 51 and the M layer 52 may not be separated from each other, and the M layer 52 and the C layer 53 may not be separated from each other. In the example illustrated in FIG. 6*a*, a rear end portion of the Y layer 51 and a front end portion of the M layer 52 are overlapped with each other, and a rear end portion of the M layer 52 and a front end portion of the C layer 53 are overlapped with each other. In the example shown in FIG. 6*b*, a rear end portion of the Y layer 51 and a front end portion of the M layer 52 are overlapped with each other, and the M layer 52 and the C layer 53 are adjacent to each other without overlapping and clearance therebetween (or are overlapped with each other over an extremely narrow width). In the example illustrated in FIG. 6*c*, the Y layer 51 and the M layer 52 are adjacent to each other without overlapping and clearance therebetween (or are overlapped with each other over an extremely narrow width), and a rear end portion of the M layer 52 and a front end portion of the C layer 53 are overlapped with each other.

The red layer R formed by overlapping of the Y layer 51 and the M layer 52 in FIG. 6*b* is wider (longer in the longitudinal direction of the thermal transfer sheet 5) than the red layer R formed by overlapping of the Y layer 51 and the M layer 52 in FIG. 6*a*. The blue layer B formed by overlapping of the M layer 52 and the C layer 53 in FIG. 6*c* is wider than the blue layer B formed by overlapping of the M layer 52 and the C layer 53 in FIG. 6*a*.

In the examples shown in FIGS. 6*a* to 6*c*, the identification unit 11 can identify the type of the thermal transfer sheet 5 based on information such as the presence or absence of the red layer R, the width of the red layer R, the presence or absence of the blue layer B, and the width of the blue layer B.

Figure 7A:
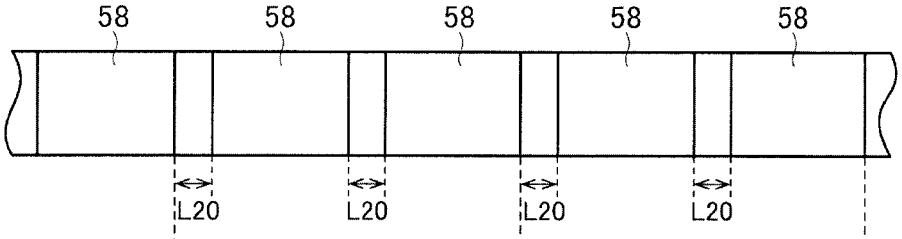
FIGS. 7*a* and 7*b* are plan views of thermal transfer sheets.
Figure 7B:
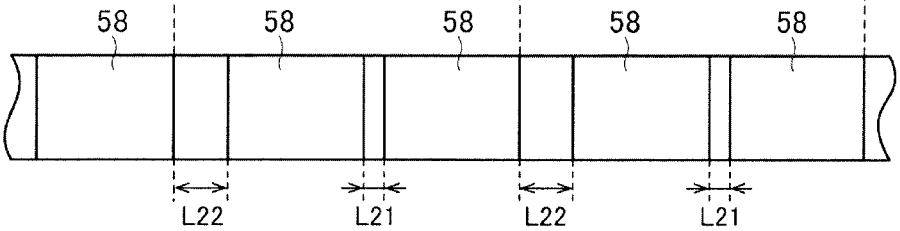

While the above embodiment has illustrated an example in which the dye layers D include dye layers of three colors, i.e., yellow, magenta and cyan, and the type of the thermal transfer sheet 5 is identified based on the interval between the Y layer 51 and the M layer 52 and the interval between the M layer 52 and the C layer 53, the dye layers D may be composed of dye layers of a single color. For example, the type of the thermal transfer sheet 5 may be expressed by arranging dye layers 58 of the same color at constant intervals (L20) as illustrated in FIG. 7*a* or at alternate different intervals between the dye layers 58 (L21<L20<L22) as illustrated in FIG. 7*b*, or may be expressed by other information such as the ratio of the interval L21 to the interval L22.

In the above embodiment, the interval between the C layer 53 and the protective layer 54 may be further measured for use in the identification of the thermal transfer sheet 5. In this case, the protective layer 54 is formed with a protective layer-forming resin containing a fluorescent whitening agent, an ultraviolet absorbing material or an infrared absorbing material. The position of the protective layer 54 is determined using a fluorescence sensor, an ultraviolet sensor or an infrared sensor, and the interval between the C layer 53 and the protective layer 54 is measured.

In the above embodiment, the thermal transfer sheet 5 may have a black dye layer or a black hot-melt ink layer disposed next to the C layer 53. In this case, the interval between the C layer 53 and the black layer may be further used in the identification of the type of the thermal transfer sheet 5.

The colorants used in the thermal transfer sheets 5 are not limited to sublimation dyes and may be other colorants such as hot-melt inks. The types of the thermal transfer sheets 5 may be identified based on the intervals of a plurality of colorant layers disposed in planar sequence in the thermal transfer sheet 5.

When the lengths L1, L2 and L3 of the Y layer 51, the M layer 52 and the C layer 53, and the length from the front end of the Y layer 51 to the rear end of the C layer 53 are constant in every types of the thermal transfer sheets 5, the sums of the length L11 of the region 55 and the length L12 of the region 56 are also constant. Thus, the type of the thermal transfer sheet 5 may be identified based on either the length L11 of the region 55 or the length L12 of the region 56.

The type of the thermal transfer sheet 5 may be identified simply based on either the length L11 of the region 55 or the length L12 of the region 56 regardless of the length from the front end of the Y layer 51 to the rear end of the C layer 53.

The intervals associated with the types of the thermal transfer sheets 5 may not be the intervals of adjacent colorant layers. For example, the type of the thermal transfer sheet 5 may be identified based on the interval between the Y layer 51 and the C layer 53, i.e., the length from the rear end of the Y layer 51 to the front end of the C layer 53.

The order in which the Y layer 51, the M layer 52 and the C layer 53 are arranged is not limited to that shown in FIG. 2.

Figure 8:
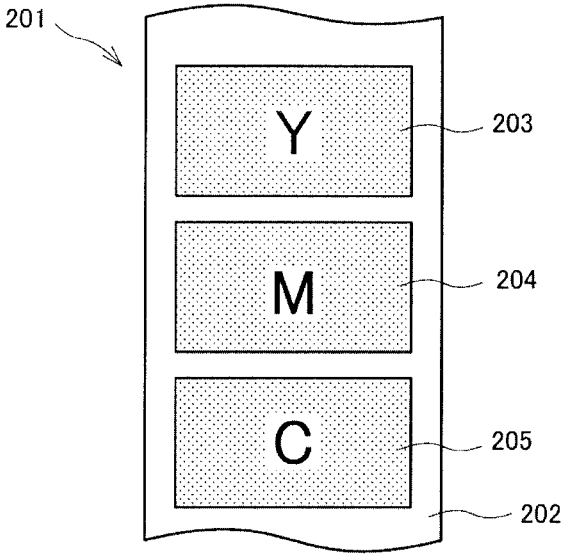
FIG. 8 is a plan view of a thermal transfer sheet according to another embodiment of the present invention.

Hereinbelow, another embodiment will be described with reference to the drawings. FIG. 8 is a plan view of a thermal transfer sheet 201 according to the present embodiment. In the thermal transfer sheet 201, a Y layer 203 containing a yellow dye, an M layer 204 containing a magenta dye, and a C layer 205 containing a cyan dye are disposed in planar sequence on one side of a base film 202. A protective layer may be disposed next to the C layer 205. A heat-resistant lubricating layer is disposed on the other side of the base film 202.

The Y layer 203, the M layer 204 and the C layer 205 are each formed on the base film 202 by a method such as gravure printing, screen printing or offset printing.

When the Y layer 203, the M layer 204 and the C layer 205 are irradiated with light, the transmittances or the reflectances of the dye layers vary depending on the densities (the color densities) of the Y layer 203, the M layer 204 and the C layer 205. In the present embodiment, the densities of the Y layer 203, the M layer 204 and the C layer 205 are changed depending on the types of the thermal transfer sheets 201 without adversely affecting the printing of images, and the type of the thermal transfer sheet 201 is identified by measuring the density pattern of the Y layer 203, the M layer 204 and the C layer 205 based on the optical transmittances or reflectances. The densities may be controlled by changing the depth of a plate used to apply the dyes onto the base film 202, and thereby giving rise to variations in the thicknesses of the dye layers.

When, for example, the densities of the Y layer 203, the M layer 204 and the C layer 205 are each set to any of three levels, "light", "normal" and "dark", the number of information patterns which can be expressed by changing the densities of the Y layer 203, the M layer 204 and the C layer 205 is 3×3×3=27.

Figure 9A:
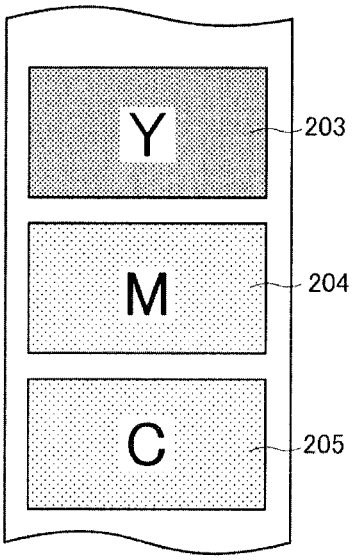
FIGS. 9*a* to 9*c* are plan views of thermal transfer sheets.
Figure 9B:
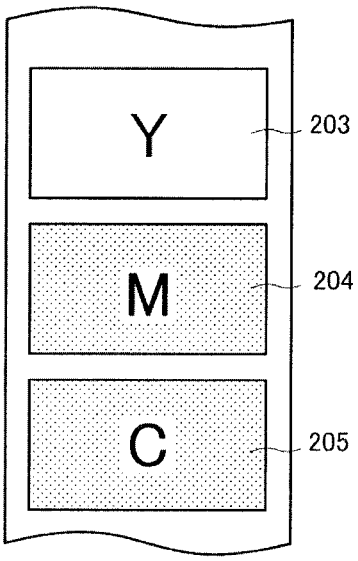
Figure 9C:
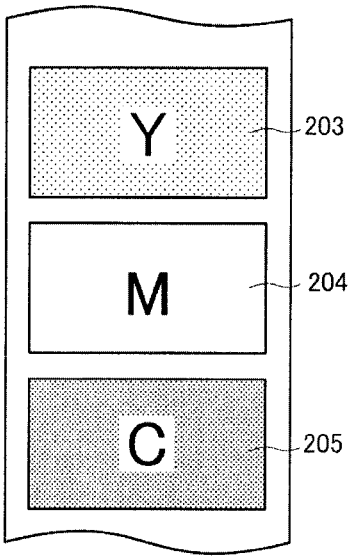

FIG. 9*a* shows a case where the densities of the Y layer 203, the M layer 204 and the C layer 205 are "dark", "normal" and "normal", respectively. FIG. 9*b* illustrates a case where the densities of the Y layer 203, the M layer 204 and the C layer 205 are "light", "normal" and "normal", respectively. FIG. 9*c* shows a case where the densities of the Y layer 203, the M layer 204 and the C layer 205 are "normal", "light" and "dark", respectively.

Figure 10:
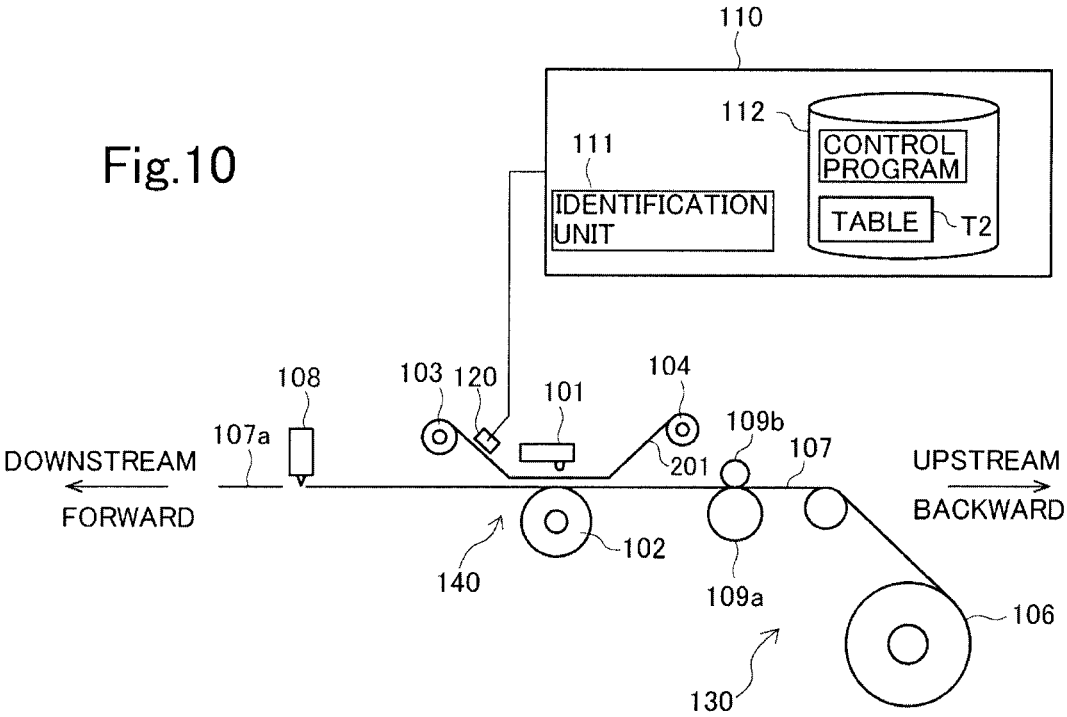
FIG. 10 is a schematic configuration diagram of a thermal transfer printing device according to an embodiment.

FIG. 10 is a schematic configuration diagram of a thermal transfer printing device according to an embodiment of the present invention. The thermal transfer printing device includes a thermal head 101 which sublimates and transfers a yellow dye, a magenta dye and a cyan dye from the thermal transfer sheet 201 onto a printing sheet 107 (photographic printing paper, receiver paper) to print an image.

A supply unit 103 which includes a reel of the thermal transfer sheet 201 is disposed downstream of the thermal head 101, and a collection unit 104 is disposed upstream of the thermal head 101. The thermal transfer sheet 201 fed from the supply unit 103 is passed under the thermal head 101 and is collected in the collection unit 104.

A rotatable platen roll 102 is disposed below the thermal head 101. A printing section 140 including the thermal head 101 and the platen roll 102 sandwiches the printing sheet 107 and the thermal transfer sheet 201, and heats the thermal transfer sheet 201 to thermally transfer the dyes onto the printing sheet 107, thus forming an image.

Upstream of the thermal head 101 are disposed a rotatably drivable capstan roller 109*a* for transporting the printing sheet 107, and a pinch roller 109*b* which presses the printing sheet 107 against the capstan roller 109*a*.

The printing sheet 107 is wound on a printing paper reel 106 and is fed from the printing paper reel 106. The printing sheet 107 may be a known sheet. A driving section 130 which includes the printing paper reel 106, the capstan roller 109*a* and the pinch roller 109*b* feeds (transports forward) and takes up (transports backward) the printing sheet 107.

The printing sheet 107 on which the image is formed at the printing section 140 is cut with a cutter 108 on the downstream side to give a printed sheet 107*a*. The printed sheet 107*a* is discharged from an outlet that is not illustrated.

Between the supply unit 103 and the printing section 140 is disposed a sensor 120 which applies light to the thermal transfer sheet 201 and measures the intensity (reflectance, transmittance) of the reflected light or the transmitted light. The sensor 120 is, for example, a color sensor, and determines the positions and types of the Y layer 203, the M layer 204 and the C layer 205, and measures the intensities of reflected light or transmitted light which correspond to the densities. For example, the color sensor senses the intensities (the ratios) of red (R), green (G) and blue b color components, and identifies the colors (the densities).

The controller 110 controls the driving of each unit or section of the thermal transfer printing device, and performs an operation to identify the thermal transfer sheet 201 and also a printing operation. The controller 110 is a computer which has a memory unit 112 including CPU (a central processing unit), a flash memory, ROM (a read-only memory) and RAM (a random access memory). The memory unit 112 stores control programs, and a table T2. CPU executing the control programs functions as an identification unit 111 which identifies the type of the thermal transfer sheet 201.

The table T2 contains types of thermal transfer sheets 201 in connection with patterns of densities of a Y layer 203, an M layer 204 and a C layer 205 of the thermal transfer sheets 201.

The identification unit 111 determines the pattern of densities of the Y layer 203, the M layer 204 and the C layer 205 based on the measurement results from the sensor 120, and, with reference to the table T2, identifies the type of the thermal transfer sheet 201 loaded in the thermal transfer printing device. The sensor 120 measures the intensity of reflected light or transmitted light with respect to a plurality of locations in each of the Y layer 203, the M layer 204 and the C layer 205. Based on the average of the intensities of reflected light or transmitted light at the plurality of locations, the density of each dye layer is determined. In this manner, it is possible to lessen the influence caused by the unevenness of the dye ink applied. The sensor 120 may measure either the reflected light intensity or the transmitted light intensity with respect to each of the Y layer 203, the M layer 204 and the C layer 205, or may measure both the reflected light intensity and the transmitted light intensity.

The table T2 may contain, instead of the patterns of densities of the Y layer 203, the M layer 204 and the C layer 205, the patterns of optical intensities of reflected light or transmitted light (measured by the sensor 120) corresponding to the densities.

The table T2 may contain information such as preferred printing conditions (printing speed, energy applied during printing) and the types of printing sheets 107 to be used, in connection with the types of the thermal transfer sheets 201. The controller 110 controls the printing operation based on the printing conditions corresponding to the type of the thermal transfer sheet 201 that has been identified. If the type of the printing sheet 107 loaded in the thermal transfer printing device does not match the type of the thermal transfer sheet 201 that has been identified, the controller 110 may output a warning sound or a warning display, or may stop the printing operation.

In the manner described above, the type of the thermal transfer sheet 201 can be identified with high accuracy based on the pattern of densities of the Y layer 203, the M layer 204 and the C layer 205 of the thermal transfer sheet 201.

While the above description has illustrated the layer configuration as having the heat-resistant lubricating layer on one side of the base film 202 and having the dye layers on the other side of the base film 202, other layers may be further added. For example, layers such as a protective layer, a heat-resistant primer layer and a dye primer layer may be provided.

Hereinbelow, the materials of the layers constituting the thermal transfer sheet 201 will be described in detail.

<Base Films>

The base film 202 may be any known film as long as it has certain levels of heat resistance and strength. For example, the film may have a thickness of about not less than 0.5 μm and not more than 50 μm, and preferably about not less than 3 μm and not more than 10 μm, and may be any of resin films such as polyethylene terephthalate films, 1,4-polycyclohexylene dimethylene terephthalate films, polyethylene naphthalate films, polyphenylene sulfide films, polystyrene films, polypropylene films, polysulfone films, aramid films, polycarbonate films, polyvinyl alcohol films, cellulose derivatives including cellophane and cellulose acetate, polyethylene films, polyvinyl chloride films, nylon films, polyimide films and ionomer films, papers and nonwoven fabrics such as condenser papers and paraffin papers, and composites of papers or nonwoven fabrics with resins.

<Heat-Resistant Primer Layers>

A heat-resistant primer layer may be formed mainly using a binder which exhibits good adhesion to both the base film and the heat-resistant lubricating layer. Examples of the binders include polyester resins, polyurethane resins, polyacrylic resins, polyvinyl formal resins, epoxy resins, polyvinyl butyral resins, polyamide resins, polyether resins, polystyrene resins and styrene-acrylic copolymers.

The heat-resistant primer layer may be formed by a method in which the above material is dissolved or dispersed in a solvent such as acetone, methyl ethyl ketone, toluene or xylene, or water selected in accordance with application suitability to give a coating liquid, which is then applied with a conventional applicator such as a gravure coater, a roll coater or a wire bar, and the wet film is dried. The amount in which the coating liquid is applied, that is, the thickness of the heat-resistant primer layer is suitably not more than 2.0 μm and more preferably not less than 0.1 μm and not more than 2.0 μm. When the thickness is 0.1 μm or above, the heat-resistant primer layer can fully exhibit the expected effects. When, on the other hand, the thickness is 2.0 μm or less, heat is favorably transferred from the thermal head and high density printing is feasible.

<Heat-Resistant Lubricating Layers>

The heat-resistant lubricating layer is formed for the purpose of enhancing properties such as the running properties on the thermal head during printing, and heat resistance. Examples of the binder resins which may be used to form the heat-resistant lubricating layers include polyester resins, polyacrylate ester resins, polyvinyl acetate resins, styrene acrylate resins, polyurethane resins, polyolefin resins, polystyrene resins, polyvinyl chloride resins, polyether resins, polyamide resins, polyimide resins, polyamideimide resins, polycarbonate resins, polyethylene resins, polypropylene resins, polyacrylate resins, polyacrylamide resins, polyvinyl chloride resins, polyvinyl butyral resins and polyvinyl acetoacetal resins. Further, various crosslinking agents may be used for the purpose of enhancing properties of the above resins such as heat resistance, film characteristics and adhesion. Further, for the purpose of enhancing running properties, release agents such as waxes, higher fatty acid amides, esters and surfactants, organic powders such as fluororesins, and inorganic particles such as silica, clay, talc, mica and calcium carbonate may be added.

The heat-resistant lubricating layer may be formed by a method similar to that described with respect to the heat-resistant primer layer. When the heat-resistant lubricating layer is formed on the base film, heating is preferably performed to accelerate the reaction between the binder resin and the polyisocyanate. To protect the dye layers from the influence of heat, it is preferable that the heat-resistant lubricating layer be formed on the base sheet before the dye layers are formed. From points of view such as enhancements in heat resistance and other properties, the thickness of the heat-resistant lubricating layer as measured after drying is preferably not more than 3 μm, and more preferably not less than 0.1 μm and not more than 2 μm.

<Dye Layers>

The dye layers which are formed are layers containing a sublimation dye.

The dyes used in the present invention are not particularly limited and may be any known dyes conventionally used in thermal transfer sheets. Examples of the dyes include diarylmethane dyes, triarylmethane dyes, thiazole dyes, methine dyes such as merocyanine, indoaniline dyes, azomethine dyes such as acetophenoneazomethine, pyrazoloazomethine, imidazoleazomethine and pyridoneazomethine, xanthene dyes, oxazine dyes, cyanomethylene dyes represented by dicyanostyrene and tricyanostyrene, thiazine dyes, azine dyes, acridine dyes, benzene azo dyes, azo dyes such as pyridone azo, thiophene azo, isothiazole azo, pyrrole azo, pyrazole azo, imidazole azo, thiadiazole azo, triazole azo and disazo, spiropyran dyes, indolinospiropyran dyes, fluoran dyes, rhodamine lactam dyes, naphthoquinone dyes, anthraquinone dyes, and quinophthalone dyes.

The dye coating liquid contains a binder and the above dye as essential components, and may optionally further contain at least one of a pigment and a conductive agent. Examples of the binder resins for holding the above dyes include cellulose resins such as ethyl cellulose, hydroxyethyl cellulose, hydroxypropyl cellulose, methyl cellulose, cellulose acetate and cellulose acetate butyrate, vinyl resins such as polyvinyl acetate, polyvinyl alcohol, polyvinyl butyral, polyvinyl acetoacetal and polyvinylpyrrolidone, acrylic resins such as poly(meth)acrylate and poly(meth) acrylamide, polyurethane resins, polyamide resins and polyester resins. Of these, cellulose resins, polyurethane resins, vinyl resins, acrylic resins and polyester resins are preferably used for reasons such as heat resistance and dye migration.

The dye layers may be formed by dissolving the dye and the binder resin, optionally together with at least one of a pigment and a conductive agent, into an appropriate organic solvent such as toluene, methyl ethyl ketone, ethanol, isopropyl alcohol, cyclohexanone or DMF, or dispersing these materials in an organic solvent, water or the like, and applying the solution or the dispersion to one side of the base film 202 by a method such as, for example, a gravure printing method, a screen printing method or a reverse roll coating printing method, followed by drying. The thickness of the dye layers as measured after drying is about not less than 0.2 μm and not more than 6.0 μm, and preferably about not less than 0.2 μm and not more than 3.0 μm.

<Dye Primer Layers>

A dye primer layer may be formed mainly using a binder which exhibits good adhesion to both the base film and the dye layers. The binder may be one similar to that used in the heat-resistant primer layer, with examples including polyester resins, polyurethane resins, polyacrylic resins, polyvinyl formal resins, epoxy resins, polyvinyl butyral resins, polyamide resins, polyether resins, polystyrene resins and styrene-acrylic copolymer resins.

The dye primer layer may be formed by a method similar to that described with respect to the heat-resistant primer layer.

<Protective Layers>

A protective layer may include any of various resins conventionally known as protective layer-forming resins. Examples of the protective layer-forming resins include polyester resins, polystyrene resins, acrylic resins, polyurethane resins, acrylic urethane resins, vinyl chloride-vinyl acetate copolymers, resins obtained by modifying the above resins with silicones, and mixtures of the above resins. The protective layer is formed by, for example, a gravure printing method. The thickness of the protective layer as measured after drying is preferably not less than 0.1 μm and not more than 2.0 μm.

The above description illustrates some examples of the present invention, and the embodiments of the present invention are not limited to those described above.

An invisible light absorbing material such as a fluorescent whitening agent, an ultraviolet absorbing material or an infrared absorbing material may be added to the Y layer 203, the M layer 204 and the C layer 205 of the thermal transfer sheet 201 in such a manner that the contents of the invisible light absorbing material differ among the Y layer 203, the M layer 204 and the C layer 205 to express information by the pattern of the contents.

When, for example, the Y layer 203, the M layer 204 and the C layer 205 are each set to either "containing" or "not containing" the invisible light absorbing material, the number of information patterns which can be expressed is 2×2×2=8.

Further, when the Y layer 203, the M layer 204 and the C layer 205 are each set to "not containing" "containing less" or "containing more" invisible light absorbing material, the number of information patterns which can be expressed by changing the contents of the invisible light absorbing material in the Y layer 203, the M layer 204 and the C layer 205 is 3×3×3=27.

In the thermal transfer printing device, the positions of the Y layer 203, the M layer 204 and the C layer 205 are determined with a color sensor. When, for example, the invisible light absorbing material is a fluorescent whitening agent, an ultraviolet light emitting element and a visible light receiving element are provided, and the Y layer 203, the M layer 204 and the C layer 205 are each irradiated with ultraviolet light to measure the fluorescent intensities and thereby to determine the contents of the fluorescent whitening agent in the respective layers.

When the invisible light absorbing material is an ultraviolet absorbing material, the Y layer 203, the M layer 204 and the C layer 205 are each irradiated with ultraviolet light and the transmitted light intensities or the reflected light intensities are measured. Based on the transmitted light intensities or the reflected light intensities, the contents of the ultraviolet absorbing material in the respective layers are determined. When the invisible light absorbing material is an infrared absorbing material, the Y layer 203, the M layer 204 and the C layer 205 are each irradiated with infrared light and the transmitted light intensities or the reflected light intensities are measured. Based on the transmitted light intensities or the reflected light intensities, the contents of the infrared absorbing material in the respective layers are determined.

The intensities of lights from the Y layer 203, the M layer 204 and the C layer 205, i.e., the intensities of lights reflected by the respective layers (the reflected light intensities), the intensities of lights transmitted through the respective layers (the transmitted light intensities), or the intensities of lights generated in the respective layers (the emission intensities) offer a pattern of contents of the invisible light absorbing material in the Y layer 203, the M layer 204 and the C layer 205, and the type of the thermal transfer sheet 201 can be identified based on the pattern. The table T2 may contain, instead of the patterns of contents of the invisible light absorbing material in the Y layer 203, the M layer 204 and the C layer 205, patterns of optical intensities (measured by the sensor) corresponding to the contents of the invisible light absorbing material. One, or two or more of the reflected light intensities, the transmitted light intensities and the emission intensities may be measured.

Examples of the fluorescent whitening agents which may be used include fluorescein compounds, thioflavin compounds, eosin compounds, rhodamine compounds, coumarin compounds, imidazole compounds, oxazole compounds, triazole compounds, carbazole compounds, pyridine compounds, imidazolone compounds, naphthalic acid derivatives, stilbenedisulfonic acid derivatives, stilbenetetrasulfonic acid derivatives and stilbenehexasulfonic acid derivatives.

For example, the fluorescence emission wavelength region is from 410 nm to 460 nm inclusive, and the peak-top fluorescence emission wavelength is 440 nm.

Examples of the ultraviolet absorbing materials include organic ultraviolet absorbing materials such as benzotriazole compounds, triazine compounds, benzophenone compounds and benzoate compounds, and inorganic ultraviolet absorbing materials such as titanium oxide, zinc oxide, cerium oxide, iron oxide and barium sulfate.

Examples of the infrared absorbing materials include diimmonium compounds, aminium compounds, phthalocyanine compounds, dithiol organometal complexes, cyanine compounds, azo compounds, polymethine compounds, quinone compounds, diphenylmethane compounds, triphenylmethane compounds and oxole compounds.

When the invisible light absorbing material is contained in the Y layer 203, the M layer 204 and the C layer 205 of the thermal transfer sheet 201, the thermal transfer printing device is provided with a color sensor (a visible light source and a visible light detection mechanism) and an invisible light sensor (an invisible light source and an invisible light detection mechanism) for determining the positions of the Y layer 203, the M layer 204 and the C layer 205. When the invisible light absorbing material is a fluorescent whitening agent, the detection is possible only with the visible light detection mechanism, and the invisible light sensor may be free from the invisible light detection mechanism. To simplify and miniaturize the structure of the detection system, it is preferable that the invisible light absorbing material added to the Y layer 203, the M layer 204 and the C layer 205 be a fluorescent whitening agent.

Figure 11A:
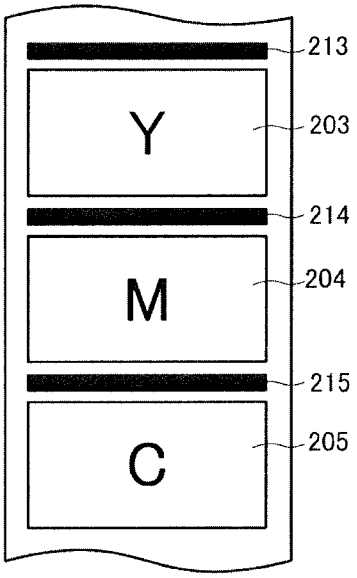
FIGS. 11*a* to 11*c* are plan views illustrating other examples of thermal transfer sheets.
Figure 11B:
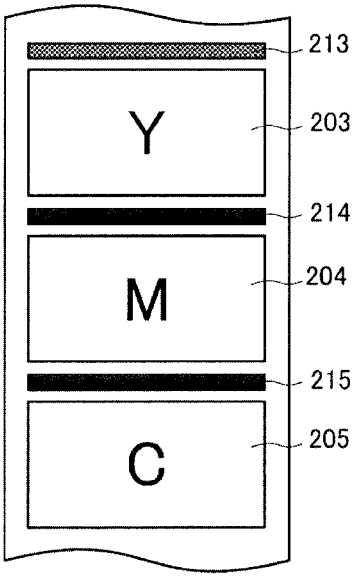
Figure 11C:
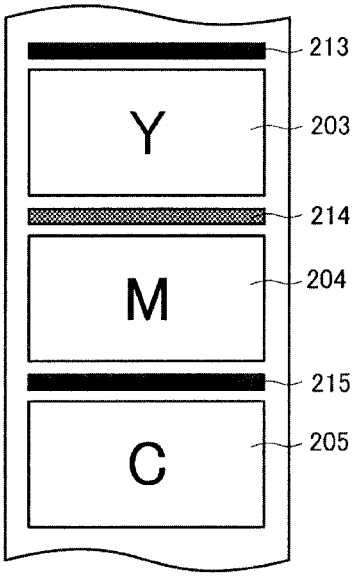

As illustrated in FIGS. 11*a* to 11*c*, the type of the thermal transfer sheet 201 may be expressed by providing detection marks 213, 14, 15 (first to third detection marks) which indicate the head positions of the Y layer 203, the M layer 204 and the C layer 205, respectively, in such a manner that the densities of the detection marks 213, 14, 15 vary from one another.

When the densities of the detection marks 213 to 215 are each set to either "normal" or "light", the number of information patterns which can be expressed is 2×2×2=8.

FIG. 11*a* shows a case where all the densities of the detection marks 213 to 215 are "normal". FIG. 11*b* illustrates a case where the densities of the detection marks 213 to 215 are "light", "normal" and "normal", respectively. FIG. 11*c* shows a case where the densities of the detection marks 213 to 215 are "normal", "light" and "normal", respectively.

The levels which indicate the densities of the detection marks 213 to 215 may further include "dark" in addition to "normal" and "light". In this manner, the range of information which can be expressed is widened. Since the detection marks 213 to 215 do not affect the printing of images, the densities thereof can be changed with a high degree of flexibility and thereby the identification accuracy can be enhanced. The densities of the detection marks are each determined based on the average of reflected light intensities measured at a plurality of locations of the detection mark. It is therefore possible to lessen the influence caused by the unevenness of the ink forming the detection mark.

The detection marks 213 to 215 may be formed using a conventional ink composition for forming detection marks. The densities may be controlled by changing the depth of a gravure printing plate, and thereby giving rise to variations in the thicknesses of the ink layers forming the detection marks.

The table T2 contains types of thermal transfer sheets 201 in connection with patterns of densities of detection marks 213 to 215. The type of the thermal transfer sheet 201 loaded in the thermal transfer printing device is identified based on the densities of the detection marks 213 to 215 determined with the sensor, with reference to the table T2.

The type of the thermal transfer sheet 201 may be identified based on the pattern of densities of dye layers or the pattern of contents of the invisible light absorbing material with respect to two dye layers selected from the Y layer 203, the M layer 204 and the C layer 205. Similarly, the type of the thermal transfer sheet 201 may be identified based on the densities of two detection marks selected from the detection marks 213 to 215.

The colors of the dyes disposed in the thermal transfer sheet 201 are not limited to yellow, magenta and cyan, and may be other colors.

The present invention may be implemented in various manners by appropriately combining the constituent elements disclosed in the above embodiments. For example, constituent elements belonging to different embodiments may be combined appropriately. For example, the thermal transfer printing device may include a first identification unit which identifies the type of the thermal transfer sheet based on the interval between the Y layer and the M layer and the interval between the M layer and the C layer of the thermal transfer sheet, and a second identification unit which identifies the type of the thermal transfer sheet based on the pattern of densities of the Y layer, the M layer and the C layer.

The present invention has been described by using specific embodiments, but it is obvious to those skilled in the art that various changes and modifications may be made without departing from the aim and the scope of the present invention.

The present application was based on Japanese Patent Application No. 2017-233478, filed on Dec. 5, 2017, and Japanese Patent Application No. 2018-006638, filed on Jan. 18, 2018, the entire disclosure of which is hereby incorporated by reference.

REFERENCE SIGNS LIST

1 THERMAL HEAD
2 PLATEN ROLL
3 SUPPLY UNIT
4 COLLECTION UNIT
5 THERMAL TRANSFER SHEET
7 PRINTING SHEET
10 CONTROLLER
11 IDENTIFICATION UNIT
12 MEMORY UNIT
20 DETECTOR
40 PRINTING SECTION
50 SUBSTRATE
54 PROTECTIVE LAYER
201 THERMAL TRANSFER SHEET
202 BASE FILM
203 Y LAYER
204 M LAYER
205 C LAYER
213-215 DETECTION MARKS
101 THERMAL HEAD
102 PLATEN ROLL
103 SUPPLY UNIT
104 COLLECTION UNIT
107 PRINTING SHEET
110 CONTROLLER
111 IDENTIFICATION UNIT
112 MEMORY UNIT
120 SENSOR
140 PRINTING SECTION

The invention claimed is:

1. A thermal transfer printing device comprising a thermal head and a platen roll and configured to superimpose a thermal transfer sheet comprising a first colorant layer, a second colorant layer and a third colorant layer with printing paper and to deliver the thermal transfer sheet and the printing paper between the thermal head and the platen roll in such a manner that the thermal head heats the thermal transfer sheet and transfers the colorants to the printing paper to form an image thereon, wherein the thermal transfer printing device comprises:

a sensor disposed between the thermal head and a supply unit configured to supply the thermal transfer sheet, applying visible light to at least two colorant layers selected from the first colorant layer, the second colorant layer and the third colorant layer, and measuring at least either of intensities of light transmitted through each of the colorant layers irradiated with the visible light and intensities of light reflected by each of the colorant layers irradiated with the visible light;

a memory storing a table containing types of thermal transfer sheets in connection with patterns of densities or patterns of optical intensifies based on the densities of at least two colorant layers selected from a first colorant layer, a second colorant layer and a third colorant layer in each type of the thermal transfer sheet; and an identification unit identifying the type of the thermal transfer sheet supplied from the supply unit based on measurement results from the sensor with reference to the table.

2. The thermal transfer printing device according to claim 1, wherein printing conditions are associated with the types of the thermal transfer sheets in the table, and wherein the thermal transfer printing device performs a printing operation under printing conditions corresponding to the type of the thermal transfer sheet identified by the identification unit.

3. The thermal transfer printing device according to claim 1, wherein the first colorant layer is a yellow dye layer, the second colorant layer is a magenta dye layer, and the third colorant layer is a cyan dye layer.

4. The thermal transfer printing device according to claim 1, wherein the sensor measures the intensities of transmitted light or reflected light with respect to a plurality of locations in each of the colorant layers irradiated with the visible light, and wherein the identification unit determines a density of each of the colorant layers based on an average of the intensities of transmitted light or reflected light with respect to the plurality of locations, and identifies the type of the thermal transfer sheet supplied from the supply unit.

5. The thermal transfer printing device according to claim 1, wherein the table contains types of thermal transfer sheets in connection with types of printing paper to be used, and wherein the thermal transfer printing device outputs a warning sound, outputs a warning display, or stops printing operation if a type of the printing paper loaded in the thermal transfer printing device does not match the type of the thermal transfer sheet identified by the identification unit.

6. A thermal transfer printing device comprising a thermal head and a platen roll and configured to superimpose a thermal transfer sheet comprising a first colorant layer, a second colorant layer and a third colorant layer with printing paper and to deliver the thermal transfer sheet and the printing paper between the thermal head and the platen roll in such a manner that the thermal head heats the thermal transfer sheet and transfers the colorants to the printing paper to form an image thereon, wherein the thermal transfer printing device comprises:

a sensor disposed between the thermal head and a supply unit configured to supply the thermal transfer sheet, applying invisible light to at least two colorant layers selected from the first colorant layer, the second colorant layer and the third colorant layer, and measuring at least one of intensities of light transmitted through each of the colorant layers irradiated with the invisible light, intensities of light reflected by each of the colorant layers irradiated with the invisible light, and emission intensities of each of the colorant layers irradiated with the invisible light;

a memory storing a table containing types of thermal transfer sheets in connection with patterns of contents of an invisible light absorbing material or patterns of optical intensifies based on the contents of at least two colorant layers selected from a first colorant layer, a second colorant layer and a third colorant layer in each type of the thermal transfer sheet; and an identification unit identifying the type of the thermal transfer sheet supplied from the supply unit based on measurement results from the sensor with reference to the table.

7. The thermal transfer printing device according to claim 6, wherein printing conditions are associated with the types of the thermal transfer sheets in the table, and wherein the thermal transfer printing device performs a printing operation under printing conditions corresponding to the type of the thermal transfer sheet identified by the identification unit.

8. The thermal transfer printing device according to claim 6, wherein the first colorant layer is a yellow dye layer, the second colorant layer is a magenta dye layer, and the third colorant layer is a cyan dye layer.

9. The thermal transfer printing device according to claim 6, wherein the invisible light absorbing material is a fluorescent whitening agent.

10. The thermal transfer printing device according to claim 6, wherein the invisible light absorbing material is an ultraviolet absorbing material.

11. The thermal transfer printing device according to claim 6, wherein the invisible light absorbing material is an infrared absorbing material.

12. The thermal transfer printing device according to claim 6, wherein the table contains types of thermal transfer sheets in connection with types of printing paper to be used, and wherein the thermal transfer printing device outputs a warning sound, outputs a warning display, or stops printing operation if a type of the printing paper loaded in the thermal transfer printing device does not match the type of the thermal transfer sheet identified by the identification unit.

* * * * *